US007670216B2

(12) United States Patent
Chilelli et al.

(10) Patent No.: US 7,670,216 B2
(45) Date of Patent: Mar. 2, 2010

(54) AUTOMATIC CLOSURE PRESSURE EQUILIZER

(76) Inventors: James E. Chilelli, 26 Meredeth Dr., Nashua, NH (US) 03063; Hubert P. Cote, 257 Joliette St., Manchester, NH (US) 03102-3019

( * ) Notice: Subject to any disclaimer, the term of this patent is extended or adjusted under 35 U.S.C. 154(b) by 125 days.

(21) Appl. No.: 11/767,641

(22) Filed: Jun. 25, 2007

(65) Prior Publication Data

US 2008/0146143 A1 Jun. 19, 2008

Related U.S. Application Data

(60) Provisional application No. 60/870,688, filed on Dec. 19, 2006.

(51) Int. Cl.
*E06B 7/08* (2006.01)
*E60B 7/08* (2006.01)

(52) U.S. Cl. ..... 454/195; 49/38

(58) Field of Classification Search ..... 454/195; 221/229; 16/78; 49/38
See application file for complete search history.

(56) References Cited

U.S. PATENT DOCUMENTS 2,495,881 A * 1/1950 Wilson ..... 16/78
3,946,523 A * 3/1976 Hebda ..... 49/38
5,115,941 A * 5/1992 Gueretta ..... 221/229
5,360,372 A * 11/1994 Newman et al. ..... 454/253

* cited by examiner

*Primary Examiner*—Steve McAllister
*Assistant Examiner*—Helena Kosanovic
(74) *Attorney, Agent, or Firm*—Bourque and Associates, PA

(57) ABSTRACT

An automatically operated opening access closure and venting mechanism includes a vent with one or more baffles inserted in and opening. The baffles are coupled to an actuator mechanism which operates the baffles as the door moves from a closed to an open position or conversely, from an open to a closed position. When the door is in a closed position, the baffles are closed to maintain the integrity of the door. As the door begins to open, the baffle opens thus equalizing the pressure on both sides of the door allowing the door to be easily pushed open and to close with minimal force.

3 Claims, 4 Drawing Sheets

AUTOMATIC CLOSURE PRESSURE EQUILIZER

RELATED APPLICATION

This application is related to and claims priority from U.S. Provisional Application No. 60/870,688 filed on Dec. 19, 2006 entitled Automatically Operated Door Pressure Equalizer, which is incorporated fully herein by reference.

TECHNICAL FIELD

The present invention relates to doors, windows and other openings in residential and commercial buildings and more particularly, relates to a device for automatically equalizing the pressure on two sides of an opening in a pressurized environment such as an exit stairway in a residential or commercial building.

BACKGROUND INFORMATION

Certain doors, particularly fire stop doors found in exit stairways of residential or commercial buildings, must be kept closed at all times due to fire and safety regulations. Many of the stairways, however, are naturally or manually pressurized or vented to be sure that in a fire or other hazardous situation, the occupants of the building can escape by means of the stairway with relatively clean air.

Although such changes to residential and commercial buildings have improved life and safety of the occupants, it has created a different problem. Because the stairways are often at a different air pressure than that found on the other side of the stairway door, doors can be nearly impossible to open in the case of a greater air pressure on the backside of the door. In order to combat this, installers or maintenance people often increase the closer pressure on the automated door closer mechanism to such a high value that the door shuts with such force that someone may be caught off guard and hurt by the force of the closing door. Indeed, it is often nearly impossible for elderly or handicapped individuals to operate such doors because of the fact that they are so difficult to open and/or close so quickly and violently. This situation results from the fact that the air pressure acting on one side or the other of such a large, solid door or other opening tends to make the door either extremely difficult to open or closes it very quickly and abruptly.

Other situations also suffer from the same problem such as, for example, in the case of a storm door on a residential home which is generally difficult to close due to the pressure that builds up between the storm door and the main house door as the storm door closes. Often this results in the storm door not closing and latching completely which can result in the door being pulled open and maybe even pulled off by the wind.

Accordingly, what is needed is a method of providing an air vent in the door, window or other opening in a structure such that when the door begins to open, an air vent automatically opens whereby air pressure is allowed to equalize on both sides of the door yet once the door is closed, the air vents will close thus maintaining the fire integrity of the door.

SUMMARY OF THE INVENTION

The present invention features and automated opening access closure and venting mechanism for an opening access such as a door, window or other opening in a structure. The mechanism includes an input device which is configured for detecting whether the opening access is in one of an open or a closed position. The automated opening and closure mechanism also includes an output device which is coupled to a covering of a vent device. The vent device is disposed in the opening access and provides an opening between a first side of the opening access and a second side. The covering is movable between an open and a closed position. The output device is configured for opening the covering of the vent device when the opening access is an open position, and for closing the covering of the vent device when the opening access is in a closed position.

The covering of the vent device may be operated either mechanically such as by pneumatic, hydraulic or direct mechanical linkage or alternatively, by other means such as electrical signal or the like.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

The present invention features an automatic opening access closure and venting mechanism for controlling the opening and closing of a vent in an opening access such as a door, such that the pressure on either side of the door may be equalized when the door is being opened and/or closed, while allowing the vent to close when the door is in the closed position, thereby retaining the integrity and fireproof protection provided by the door. Although the present invention will be explained in connection with a door as an opening access, this is for illustrative purposes only and is not a limitation of the present invention as any type of opening access may utilize and benefit from the present invention.

Figure 1:
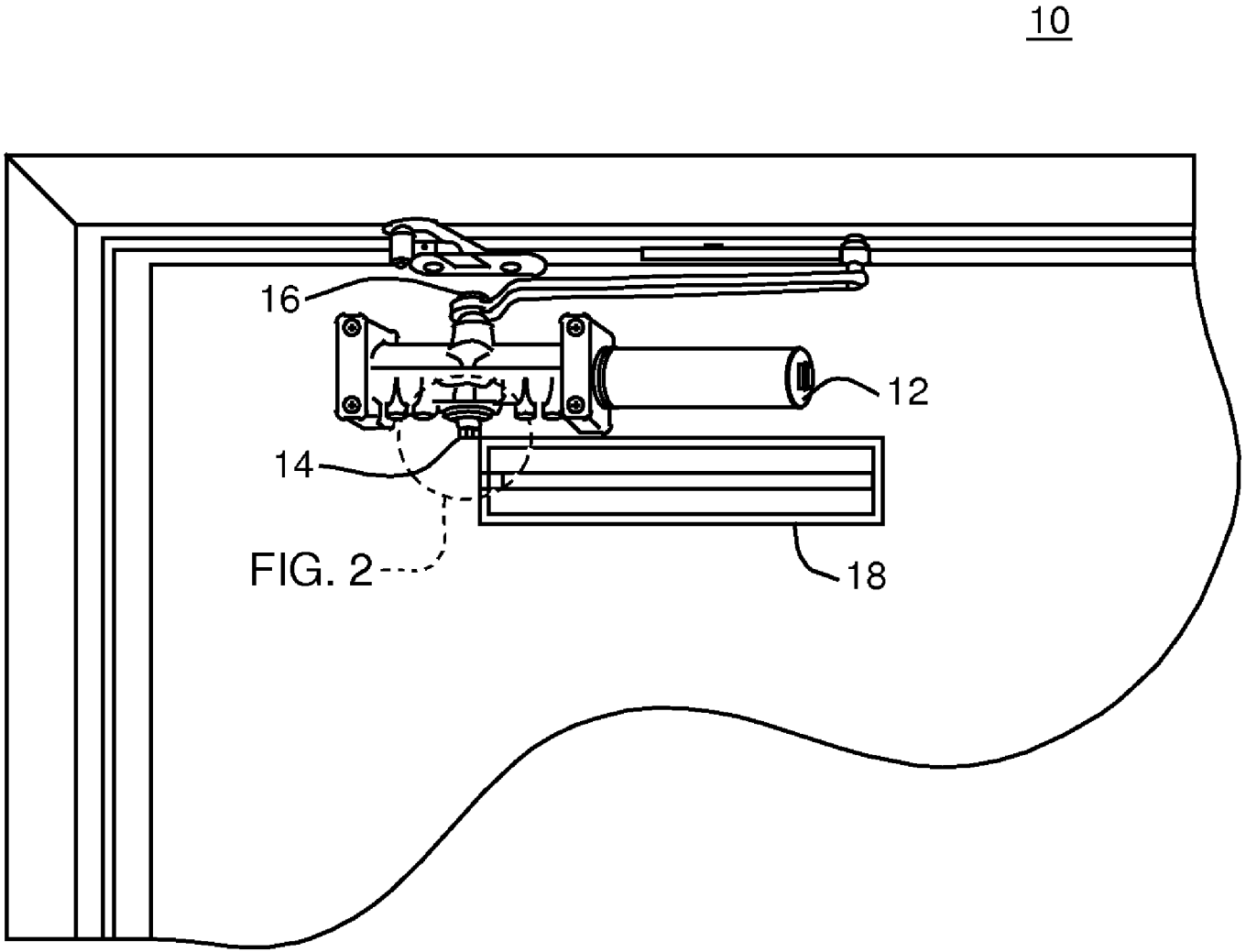
FIG. 1 is schematic view of one embodiment of the implementation of an automated closure pressure equalizer in accordance with the present invention.

In one embodiment, the automated opening access closure and venting system 10, FIG. 1, works in conjunction with a standard door closer 12 presently found on most industrial, commercial or large residential complex doors. These standard closers 12 include an output device such as a bottom spindle 14 which has, to date, not generally widely been used but is merely provided as a continuation of the top spindle 16 which serves as an input device as will be explained in greater detail below.

Figure 2:
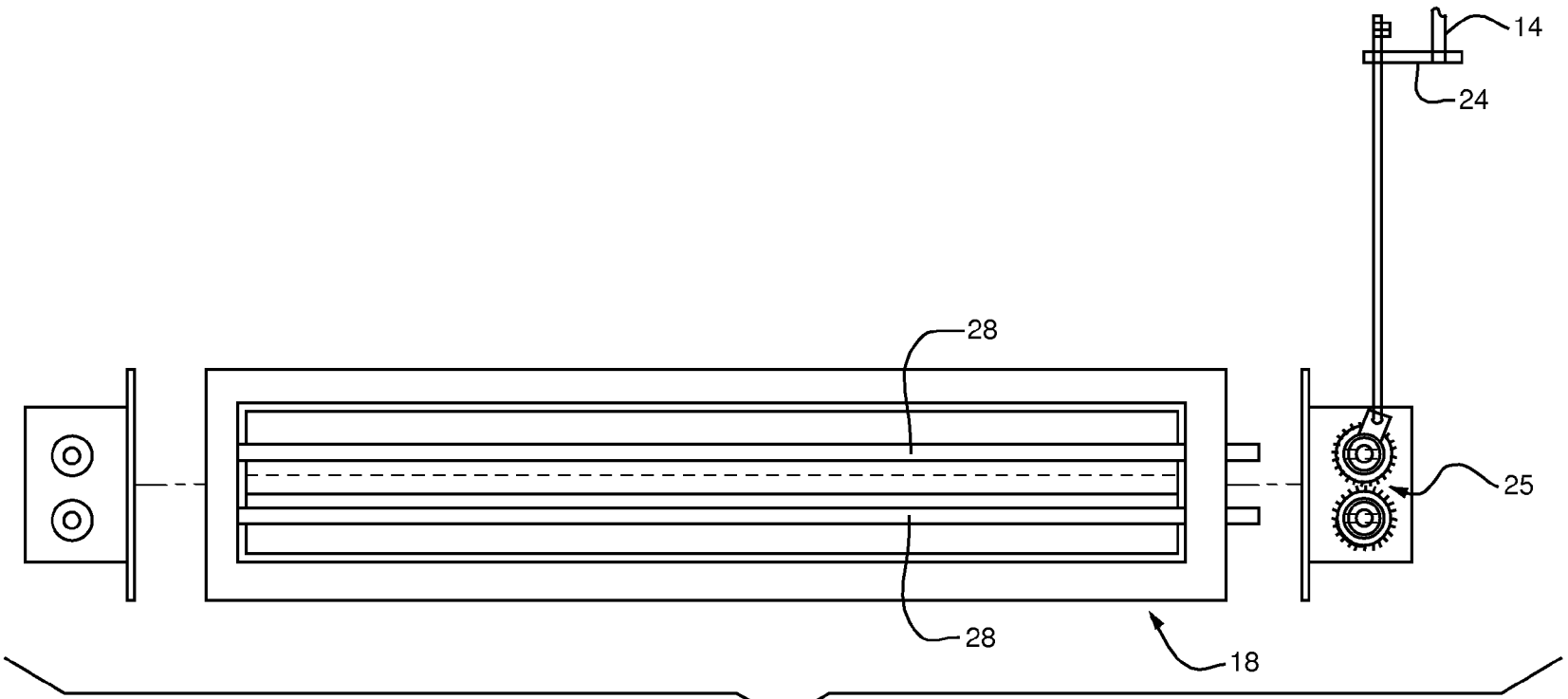
FIG. 2 is an exploded front view of an air vent and operating member in accordance with the embodiment shown in FIG. 1.

In accordance with this embodiment of the present invention, a venting device such as an air flow baffle system 18, FIG. 2, is provided which includes a closer coupling device 24 which is configured to couple to the bottom spindle 14 of a door closer 12. The closer coupling device 24 in the form of a rod or the like, is configured to operate a mechanism 25 which in turn is coupled to one or more baffles 28 on the venting device 18. When the door is in the closed position, the baffles 28 are maintained vertically in a "closed" position and are of sufficient size, material and thickness to meet any fire code ratings of the remainder of the door. In addition, the baffle system 18 may include a region of sealing tape, foam or the like (not shown) within the baffle system or around the perimeter to seal the one or more baffles 28 within the baffle system to prevent air or smoke from infiltrating from one side of the door to another.

Once the door begins to open, however, the spindle 16 of the door closer 12 acting as the input device begins to rotate which in turn causes the spindle 14 of the door closer 12 acting as the output device to rotate which in turn rotates or moves connector mechanism 34 which rotates mechanism 25 (of which a top view is shown in FIG. 5) which causes the baffles 28 to turn to a horizontal position thereby allowing airflow through the vent 18 from one side of the door to the other. In this manner, the pressure on both sides of the door is equalized so that the door can easily be opened and is also prevented from slamming shut with too much force.

Figure 3:
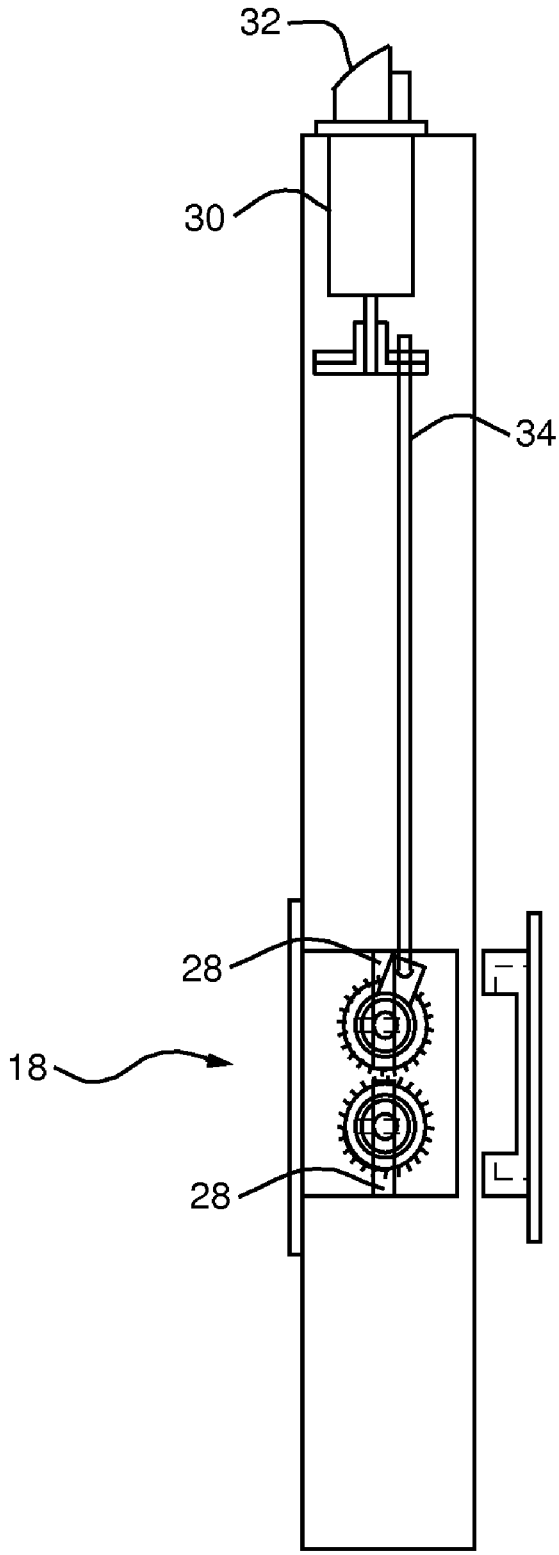
FIG. 3 is a schematic view of another embodiment of the automated door pressure equalizer in accordance with the present invention.

In another embodiment, the vent mechanism 18, FIG. 3, may be operated by means of a latch 30 located in the top portion of the door. In this embodiment, the latch mechanism 32 contacts the doorjamb and serves as the input device which causes the output device shown as connector member 34 to close the baffles 28 when the door is in the closed position. As the door begins to open, however, the latch mechanism 32 begins to disengage from the door jamb which in turn moves connector member 34 thereby opening the baffles 28. Numerous other mechanisms and methods for opening and closing the baffles in a vent when the door opens and/or closes are contemplated by the present invention and considered within the scope of the invention as such is known to someone of ordinary skill in the art including, but not limited to pneumatic, hydraulic and electrical (for example connected to a fire alarm system) methods and/or systems.

Figure 4:
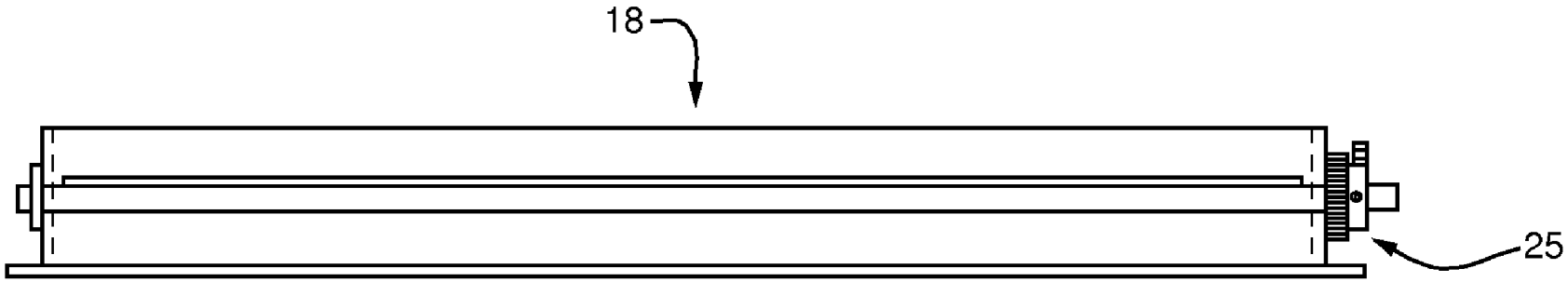
FIG. 4 is a top view of one embodiment of an air vent which forms part of the automated door pressure equalizer of the present invention.

It is contemplated that the door vent which forms part of the present invention will be located and sized to accommodate the size of the door and the air pressures then existing in a particular environment. In one embodiment, it is contemplated that the door vent 18, FIG. 4, will be approximately 16 inches long and 3.5 inches high and contain two baffles, although this is not a limitation of the present invention.

It is important to note that the present invention is not intended to be limited to a system or method which must satisfy one or more of any stated objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the allowed claims and their legal equivalents.

What is claimed is:

1. An automated opening access closure and venting mechanism for an opening access disposed in an opening defined by a frame having a plane, and that is movable between an open position and a closed position in said opening, said automated opening access closure and venting mechanism comprising:

an input device, coupled to said opening access and to said opening frame, and configured for detecting whether said opening access is in one of an open position or a closed position;

an opening access vent device, disposed in said opening access and movable between an open position and a closed position, said opening access vent device configured, in said open position, for providing an opening between a first side of said opening access and a second side of said opening access; and an output device, coupled to said input device and to said opening access vent device, and responsive to whether said opening access is in one of said open position or said closed position, wherein said output device opens said opening access vent device when said opening access is in said open position, and closes said opening access vent device only when said opening access is in said closed position.

2. The mechanism of claim 1, wherein said opening access as a door.

3. An automated opening access closure and venting mechanism for a door disposed in an opening defined by a frame having a plane, said door movable between an open position nor completely disposed in said plane of said opening frame, and a closed position generally completely disposed in said plane of said opening frame, said automated opening access closure and venting mechanism comprising:

a latch located on said door; and operable between a closed position and an open position, in said closed position; at least a portion of said latch in contact with a doorjamb when said door is in said closed position and the latch disengages from said doorjamb as the door opens, said latch configured for detecting whether said door is in one of said open or said closed position in said opening;

an opening access vent device, disposed in said door and including one or more baffles movable between an open position and a closed position, said opening access vent device configured for providing an opening for movement of air between a first side of said door and a second side of said door;

a connector member, coupled between said latch and said opening access vent device, and responsive to whether said latch is engaged with said doorjamb, wherein said connector member opens said one or more baffles in said opening access vent device, when said latch is disengaged with said doorjamb and closes said one or more baffles in said opening access vent device only when said latch is engaged with said doorjamb.

* * * * *